US006523286B2

(12) United States Patent
Leicher

(10) Patent No.: US 6,523,286 B2
(45) Date of Patent: Feb. 25, 2003

(54) METHOD FOR MONITORING OPENED CONTAINERS OF FOODSTUFFS

(76) Inventor: Gail A. Leicher, 27 Patterson Rd., Lexington, MA (US) 02421

( * ) Notice: Subject to any disclaimer, the term of this patent is extended or adjusted under 35 U.S.C. 154(b) by 0 days.

(21) Appl. No.: 09/503,295

(22) Filed: Feb. 14, 2000

(65) Prior Publication Data

US 2002/0166274 A1 Nov. 14, 2002

(51) Int. Cl.[7] ..... G09F 3/00; G09F 7/04
(52) U.S. Cl. ..... 40/311; 40/600
(58) Field of Search ..... 62/125; 215/365; 40/299.01, 310, 311, 600, 621, 637

(56) References Cited

U.S. PATENT DOCUMENTS 3,508,356 A * 4/1970 Ross ..... 40/600
3,837,100 A * 9/1974 Guida ..... 40/637
4,176,478 A * 12/1979 Brewer ..... 40/107
4,389,963 A * 6/1983 Pearson ..... 116/308
5,040,296 A * 8/1991 Yerger ..... 40/638 X
5,711,160 A * 1/1998 Namisniak et al. ..... 62/125
5,802,015 A * 9/1998 Rothschild et al. ..... 368/10
6,000,159 A * 12/1999 Hornung ..... 40/311 X
6,397,503 B1 * 6/2002 Cain et al. ..... 40/110

* cited by examiner

*Primary Examiner*—Brian K. Green

(57) ABSTRACT

A method of identifying the day in which baby food containers are opened. The method includes providing a first set of markers and a second set of markers. Each of the markers include indicia indicating the day of the week. The markers in the first set of markers are distinguishable from the markers in the second set of markers by color or shape. The first set of markers are placed on opened baby food containers that include a known food, i.e. a type of food which the baby/child is not allergic to. The second set of markers are placed on opened baby food containers that include a food that is being newly introduced to the baby/child. The second set of markers serving as a safety device in aiding identification of food-induced allergies.

12 Claims, 1 Drawing Sheet

METHOD FOR MONITORING OPENED CONTAINERS OF FOODSTUFFS

BACKGROUND OF THE INVENTION

This invention relates to previously opened containers of food and particularly to such containers of food intended to be eaten by children.

Typically, food intended for consumption by children, particularly intints, that are being or have been weaned, is sold in or stored in glass containers with a metallic lid. Such containers had been usually carefully presterilized and thus may be stored for lengthy periods prior to opening. After opening, however, it is customary to place the container with such food in it as has not been consumed immediately, in a refrigerator in order to retard spoilage. An usual parent, busy with the demands of everyday living, may have several such containers stored in the refrigerator and it is unreasonable to expect that memory of when the food was stored is readily recollected. Unfortunately, for at least two pertinent reasons, the date of opening of the containers is important: food that has been left for any lengthy amount of time may become contaminated and induce illness if fed to a child, and even if the food is comestible, it may contain allergens that have caused a reaction and therefore should no longer be fed to the child.

The majority of packaged baby or children's food is marked with an "use by" date, but it is also extremely important that the parent be aware of how long each opened container is safe for a child's consumption. This is particularly important in the event that the child has been under the care of an alloparent such as a baby-sitter, grandparent, nanny or the like who was responsible for opening a container that was subsequently refrigerated with part of the original contents, yet is not necessarily available to provide that information. When there is any doubt that the contents of an opened jar are safe or fresh, most parents apparently follow the adage "when in doubt, throw it out".

Food allergies are a common problem with babies and small children following the introduction of a specific food into the child's diet. Normally, when a child exhibits some type of allergic reaction, a pediatrician will query as to what and when new food, if any, was recently introduced into the child's diet. Yet, it may be difficult, if not impossible, for a busy parent to remember, possibly days after introducing the new food to the child, the nature of the food and the date on which it was fed to the child.

DESCRIPTION OF THE RELATED ART

Systems used to identify food items deposited in a refrigerator are known. U.S. Pat. No. 3,837,100 issued Sep. 24, 1974 to M. C. Guida, discloses a chart for identifying refrigerated containers of foodstuffs, the chart being attachable to a refrigerator and having a row of numbers denoting corresponding food items. Pressure-sensitive tabs bearing those numbers can be removed from the chart and applied to the containers on deposit of the latter in the refrigerator. The color of the tabs indicates the relative perishablility of the food in the containers. Index numbers are also set forth on the chart to indicate the location of each container in the refrigerator, which is similarly marked internally to denote locations within the refrigerator. The chart further is intended to display such information as the servings remaining in each container and the dates of deposit, all in the form of entries to be made on the chart by hand, ostensibly contemporaneously at the time of the deposit of the container. Such a system requires frequent intervention by the user, particularly to make and erase entries, to find a writing instrument that may easily be mislaid, and may not identify with precision, the extent of the storage interval of the containers.

Other systems are also known such as those set forth in U.S. Pat. No. 5,487,276 issued to Namniak et al, disclosing an electronic food inventory system attachable to a refrigerator door and requiring that information as to perishability to be stored on the refrigerator body. U.S. Pat. No. 3,837,104 issued to Broschi disclosing a record-keeping system that can be employed with food, but is not applied to the food items per se; and U.S. Pat. No. 4,235,459 that teaches a general color or shape-coded marking system

SUMMARY OF THE INVENTION

A principal object of the present invention is then to provide a system for simply and positively identifying when a container, such as a jar of partially consumed baby food typically stored in a refrigerator, was first opened, thereby eliminating any doubt as to its safety and freshness. Another important object of the present invention is to provide a safety system that permits a parent and/or physician to clearly identity a possible source of food allergy symptoms. Yet other objects of the present invention are to provide such systems in which the opened, stored containers can be easily and conveniently identified with a first set of markers that do not necessarily involve any more effort on the part of the individual than simply applying a conveniently disposed token or marker on each such container, to provide such marker in the form of magnetic items that can be releasably stored for use on a magnetizable metal exterior wall of a refrigerator or a magnetizable metallic storage board and transferred easily to adhere magnetically to a magnetizable metal cap of such containers; to provide each such marker with premarked or printed indicia that indicate a day of the week when the marker was applied to the container, so that minimally there are seven such tokens each bearing the name of a different day; and to provide means such as a board for storing such markers, with space on the board to record, but only if desired, pertinent data such as the nature of the introduced food, current allergies, important telephone numbers such as local poison control, one's pediatrician, the number of the local hospital and the like. Alternatively the markers or tokens can be made as flexible, plastic "snap-on" covers that can be used to replace the original caps and recover the partially consumed contents in a container, although such plastic replacement covers are not particularly durable and do not provide the flexibility of magnetic markers, for example for use with different size containers.

Another and important object of the present invention is to provide an alternative embodiment that includes a second set of markers that are uniquely identifiable so as to be distinguishable from the first set of markers and serve to indicate a possible adverse reaction to a foodstuff that had been contained in a container marked with a marker of that second set.

Accordingly, to effect the foregoing and other objects, the present invention generally comprises a plurality of at least seven markers or tokens adapted to couple with a container of food, each of such markers being permanently marked with a corresponding day of the week, and a storage medium, preferably in the form of a board or other device to which the markers can be removably attached. Yet another form of the present invention includes a first set of at least seven such markers, each bearing a notation of a corresponding day of the week, and another set of at least seven markers, distinguishable from the first set an bearing indicia that serves to identify a marked container as having included a foodstuff that may have an adverse effect such as an allergic reaction, on the consumer thereof Other objects of the present invention will in part be obvious and will in part appear hereinafter. The invention accordingly comprises the features, properties and relation of components, all of which are exemplified in the following detailed disclosure and the scope of which will be indicated in the claims.

BRIEF DESCRIPTION OF THE DRAWINGS

For a fuller understanding of the nature and objects of the present invention, reference should be had to the following detailed description taken in connection with the accompanying drawing in which like numerals denote like parts, and wherein.

DESCRIPTION OF THE PREFERRED EMBODIMENTS

Figure 1:
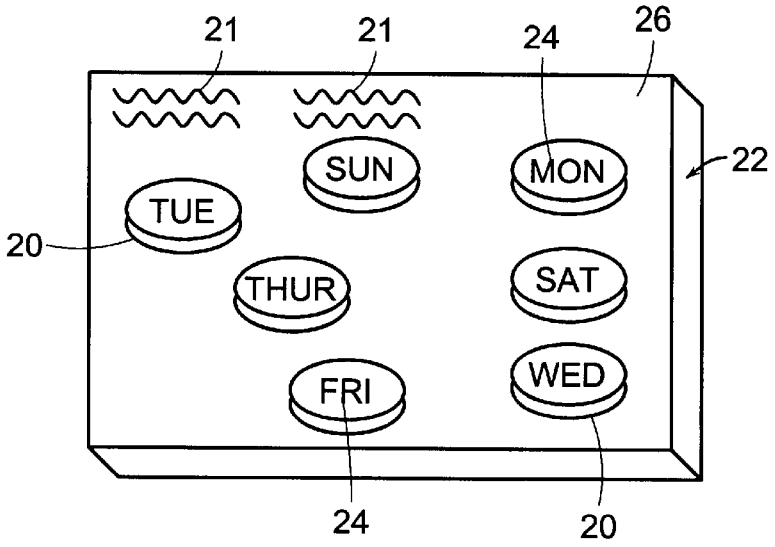
FIG. 1 is a perspective view of a board and releasably attached markers.

As shown in FIG. 1, the apparatus of the present invention is formed of a plurality of markers 20, and medium 22 for releasably storing same. It will be apparent hereinafter that the apparatus of the present invention does not require that any hand-written notations be made to describe the nature of foodstuffs disposed in containers that have been opened or the time at which such containers were opened. In using the present invention, merely releasing an appropriately identified marker from the storage medium and applying it to a container is sufficient. The host of detail provided or required by the prior art can be confusing and often extraneous; the present invention provides a simple system that yields primarily the information desired.

The markers used with the present invention are characterize by three basic aspects. As shown in FIG. 1, each marker 20 is a solid, durable item or object that bears a permanent visual identification corresponding to a respective one of the days of the week. Thus, minimally there are seven markers, each bearing a corresponding notation 24 such as "Sunday", "Monday", "Tuesday" etc. or an abbreviation thereof. The notation may be printed, engraved, cast or applied in any manner necessary to provide easy viewing and relative permanency. The markers may be formed of metallic, ceramic, wooden, polymeric or like materials, and may assume any of a large number of desired shapes, ie. cubes, discs, pyramids, hemispheres and the like. Lastly, markers 20 are adapted to be releasably attachable to containers of foodstuffs, typically to the covers or caps of the containers.

Markers 20 are intended to be stored by, in or on storage medium 22 that may be as simple as a box or the like. The preferred embodiment of medium 22 comprises relatively flat, stiff sheet 26 or slab of material to which markers 20 can be releasably attached. In this respect, at least one mating surface of the markers is preferably formed of a material that serves to cooperate to releasably couple the markers to sheet 26 and to the desired container of foodstuff. To this end, the mating surface of markers 20 may include a pressure-sensitive material that will adhere releasably to the material of sheet 26 and to a surface of a container. While such adherent surfaces are feasible, they tend to degrade with time and usage and limit the life of the apparatus.

Consequently, the preferred embodiment of the apparatus of the invention employs markers 20 that include magnetic material, ie. material that possesses a magnetic field of sufficient intensity so as to be capable of coupling securely with a cover of a food contained that is itself made with magnetizable material, i.e. one having a positive and preferably relatively high magnetic susceptibly, for example, a susceptibility that is higher than, for example, paramagnetic material In such case, sheet 26 also includes magnetizable material with the desired positive magnetic susceptibility so that it can releasably couple with the magnetic marker 20 when the latter is placed in contact with sheet 26.

In yet another alternative embodiment, markers 20 can be configured to match the metallic caps of the food containers, and made of a flexible, polymeric material such as polyethylene or the like, and therefor simply used to replace the original cap. In such case, however, the substitute caps or markers, being in possible contact with the food per se, will require periodic cleaning or sterilization and consequently are not as convenient for use as the magnetic markers.

Storage medium 22 of the present invention can be any of a large number of devices, depending on the nature of the markers. For example, where the markers are plastic caps, the storage device can simply be a box or other container that can conveniently be attached to or disposed adjacent the refrigerator or freezer as the case may be. If the markers are intended to pressure-sensitively adhere to the storage medium, the latter may simply be formed of a board or slab of material having an adherent surface, and indeed, can be the side of the refrigerator itself. In the preferred embodiment, where the present invention employs magnetic coupling of markers 20 to the food-container caps and to storage medium 22, the latter, again may simply be the side of the refrigerator or a separate sheet of magnetizable material such as iron, steel or the like, typically attached to the refrigerator by suitable means such as suction cups, adhesives and the like.

Figure 3:
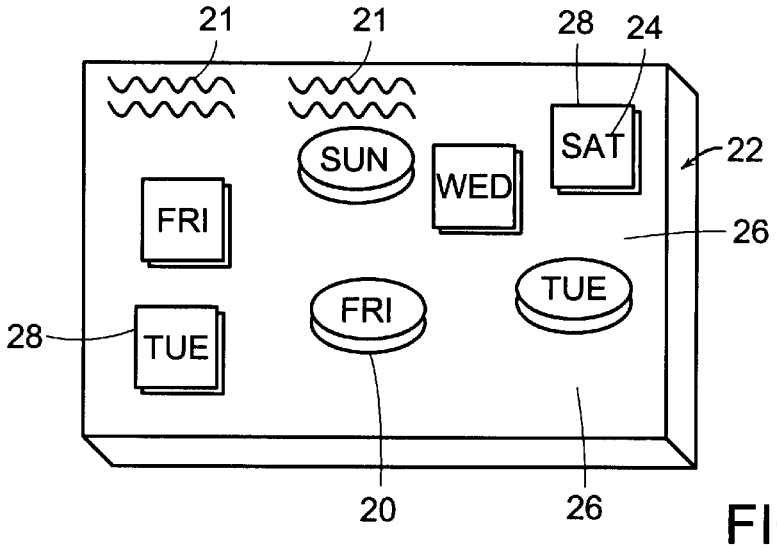
FIG. 3 is a perspective view of a board with two different sets of markers releasably attached

Another preferred embodiment of the present invention, illustrated in FIG. 3, comprises at least a first set of at least seven markers 20 (only representative ones being shown) of the type hereinbefore described bearing indicia 24 denoting the respective days of the week. Of course, more than one such set may be provided for use on multiple containers opened on a particular day. This embodiment of the invention also includes at least a second set of markers 28 that are distinguishable from markers 20 of the first set in order to serve as identifiers of marked containers that include a foodstuff that may cause an allergic response or reaction in the child fed from those containers. Such markers 28 of the second set serve as a safety device in aiding identification of food-induced allergy symptoms when those foods have first been introduced into the child's menu. In such case, each marker 28 of the second set, intended to serve as an allergy identifier, also bears the requisite permanent visual identification legend 24 of the day of the week, but is distinguishable from markers 20 by including a further identifying characteristic, such as, for example, a different shape (as shown), color, or other characteristics or a combination of such characteristics unique to markers 28.

Figure 2:
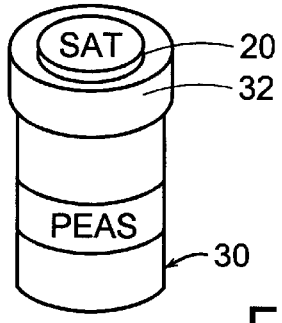
FIG. 2 is a perspective view of a container to which a marker has been affixed.

In use of the apparatus of the present invention as shown in FIG. 2, after container 30 of baby food or the like has been opened and it is desired to cold-store a remainder of the food therein, cap 32 is replaced and the recapped container with the remainder of the food is placed in a refrigerator. A marker 20, appropriately identified with the day of the week on which that container 30 is placed in storage, is removed from board 26 and attached to cap 32 of the recapped container. This also accords an opportunity for the user to review legends 24 on any other markers that may be attached to respective containers 30 in the refrigerator to ascertain whether or not one or more of such other containers should be discarded, depending upon the particular day on which they were also stored. Further, if the container being placed into storage contains food that had just been newly introduced to the child, the user has the option of employing one of markers 28 that is distinguishable from the ordinary week-day type markers to indicate that the container so marked holds a food newly introduced into the child's diet. Accordingly, if the child then displays a food-related allergic response within a few days, then positive identification of the food under suspicion is easily effected by any of the child's caregivers.

It will be recognized that, although not a necessary aspect of the present invention, board or sheet 26 can also have printed thereon inscriptions (21) providing space for hand-written entries, for example, indicating the nature of current allergies, the location and telephone number of local poison control organizations, and pediatric resources.

The following method steps are used in identifying baby food containers with the apparatus:

providing a medium;

releasably attaching a first set of markers to the medium, each of said first set of markers having indicia indicating a day of the week;

releasably attaching a second set of markers to the medium, each of said second set of markers having indicia indicating a day of the week, the second set of markers having a color or shape which is different than a color or shape of the first set of markers, the second set of markers serving as a safety device in aiding identification of food-induced allergy symptoms;

providing a baby food container having a lid and including a known food that a baby or child is not allergic to;

introducing the known food to the baby or child;

attaching one of said first set of markers to the lid of the baby food container for indicating the day of the week upon which the baby food container was opened, providing a second baby food container having a lid and including a new food which will be newly introduced to the baby or child;

introducing the new food to the baby or child;

attaching one of said second set of markers to the lid of the second baby food container for indicating the day of the week upon which the baby food container was opened and that the food in the second container holds a food that was newly introduced to the baby or child.

Since certain changes may be made in the above-apparatus without departing from the scope of the invention herein involved, it is intended that all matter contained in the above-description or shown in the accompanying drawings shall be interpreted in an illustrative and not in a limiting sense.

What is claimed is:

1. A method of identifying baby food containers comprising:

providing a medium;

releasably attaching a first set of markers to the medium, each of said first set of markers having indicia indicating a day of the week;

releasably attaching a second set of markers to the medium, each of said second set of markers having indicia indicating a day of the week, the second set of markers having a color which is different than a color of the first set of markers, the second set of markers serving as a safety device in aiding identification of food-induced allergy symptoms;

providing a baby food container having a lid and including a known food that a baby or child is not allergic to;

introducing the known food to the baby or child;

attaching one of said first set of markers to the lid of the baby food container for indicating the day of the week upon which the baby food container was opened, providing a second baby food container having a lid and including a new food which will be newly introduced to the baby or child;

introducing the new food to the baby or child;

attaching one of said second set of markers to the lid of the second baby food container for indicating the day of the week upon which the baby food container was opened and that the food in the second container holds a food that was newly introduced to the baby or child.

2. The method of identifying baby food containers as defined in claim 1 further including the step of making the markers out of a magnetic material.

3. The method of identifying baby food containers as defined in claim 1 further including the step of making the medium from a magnetizable material.

4. The method of identifying baby food containers as defined in claim 1 further including the step of printing inscriptions on the medium for providing space for hand-written entries.

5. The method of identifying baby food containers as defined in claim 1 further including the step of making the medium from a substantially flat board which is adapted to be connected to an exterior surface of a refrigerator.

6. The method of identifying baby food containers as defined in claim 1 further including the step of making the lids from a magnetizable material.

7. A method of identifying baby food containers comprising:

providing a medium;

releasably attaching a first set of markers to the medium, each of said first set of markers having indicia indicating a day of the week;

releasably attaching a second set of markers to the medium, each of said second set of markers having indicia indicating a day of the week, the second set of markers having a shape which is different than a shape of the first set of markers, the second set of markers serving as a safety device in aiding identification of food-induced allergy symptoms;

providing a baby food container having a lid and including a known food that a baby or child is not allergic to;

introducing the known food to the baby or child;

attaching one of said first set of markers to the lid of the baby food container for indicating the day of the week upon which the baby food container was opened, providing a second baby food container having a lid and including a new food which will be newly introduced to the baby or child;

introducing the new food to the baby or child;

attaching one of said second set of markers to the lid of the second baby food container for indicating the day of the week upon which the baby food container was opened and that the food in the second container holds a food that was newly introduced to the baby or child.

8. The method of identifying baby food containers as defined in claim 7 further including the step of making the markers out of a magnetic material.

9. The method of identifying baby food containers as defined in claim 7 further including the step of making the medium from a magnetizable material.

10. The method of identifying baby food containers as defined in claim 7 further include the step of printing inscriptions on the medium for providing space for hand-written entries.

11. The method of identifying baby food containers as defined in claim 7 further including the step of making the medium from a substantially flat board which is adapted to be connected to an exterior surface of a refrigerator.

12. The method of identifying baby food containers as defined in claim 7 further including the step of making the lids from a magnetizable material.

* * * * *